United States Patent [19]

Nagase et al.

[11] 4,386,591

[45] Jun. 7, 1983

[54] METHOD OF AND APPARATUS FOR CONTROLLING THE AIR INTAKE OF AN INTERNAL COMBUSTION ENGINE

[75] Inventors: Masaomi Nagase, Toyota; Hideo Miyagi, Okazaki; Masumi Kinugawa, Kariya, all of Japan

[73] Assignees: Toyota Jidosha Kogyo Kabushiki Kaisha, Toyota; Nippondenso Co., Ltd., Kariya, both of Japan

[21] Appl. No.: 303,492

[22] Filed: Sep. 18, 1981

[30] Foreign Application Priority Data

Sep. 25, 1980 [JP] Japan ..... 55/132267

[51] Int. Cl.[3] ..... F02D 9/02

[52] U.S. Cl. ..... 123/339; 123/352

[58] Field of Search ..... 123/327, 339, 350, 352, 123/585

[56] References Cited

U.S. PATENT DOCUMENTS

| | | | |
|---|---|---|---|
| 3,661,131 | 5/1972 | Croft | 123/339 |
| 4,237,838 | 12/1980 | Kinugawa et al. | 123/327 |
| 4,289,100 | 9/1981 | Kinugawa et al. | 123/339 |
| 4,291,656 | 9/1981 | Miyagi et al. | 123/339 |
| 4,306,527 | 12/1981 | Kinugawa et al. | 123/327 |
| 4,337,742 | 7/1982 | Carlson et al. | 123/350 |

*Primary Examiner*—Charles J. Myhre
*Assistant Examiner*—Andrew M. Dolinar
*Attorney, Agent, or Firm*—Cushman, Darby & Cushman

[57] ABSTRACT

The sectional area of an air bypass passage which is bypassing a throttle valve in an intake passage of an internal combustion engine is increased or decreased depending upon the difference between the actual rotational speed of the engine and the variable desired rotational speed. The variable desired rotational speed is slowly changed with respect to time according to an increment rate or to a decrement rate, when the operating condition of the engine and/or the load condition of the engine changes.

16 Claims, 6 Drawing Figures

| Fig. 2A |
|---|
| Fig. 2B |

METHOD OF AND APPARATUS FOR CONTROLLING THE AIR INTAKE OF AN INTERNAL COMBUSTION ENGINE

BACKGROUND OF THE INVENTION

The present invention relates to a method of controlling the flow rate of air intake of an internal combustion engine, particularly during idling or deceleration.

There is known a method of controlling air intake of an internal combustion engine when a throttle valve disposed in an intake passage is at the fully closed position. According to this conventional method, the flow rate of intake air, when the throttle valve is fully closed, is controlled by adjusting a control valve disposed in an air bypass passage which interconnects the intake passage at a position located upstream of the throttle valve with the intake passage at a position located downstream of the throttle valve. Such an air intake control method is usually employed for controlling the idling rotational speed of the engine. The idling rotational speed can be controlled by a closed loop if the bypass control valve is adjusted to control the flow rate of the air sucked into the engine through the bypass passage so that the detected actual rotational speed of the engine becomes equal to the desired idling rotational speed.

The desired rotational speed is usually changed depending upon the change of the operating condition of the engine and/or upon the change of the load condition of the engine. In this case, the change of the operating condition corresponds to, for example, the change of the coolant temperature of the engine, the position of a starter switch, and/or the change of the position of the throttle valve. Furthermore, the change of the load condition corresponds to the on-off switching of an air conditioner, and/or the change of the shift position of an automatic transmission from the neutral range or the parking range (these ranges are hereinafter referred to as the N range) to the drive range (hereinafter referred to as the D range) and vice versa.

However, according to the conventional control method, since the desired rotational speed is changed abruptly in response to the change of the operating condition and/or of the load condition, the actual rotational speed which is controlled, by the closed loop control, depending upon the difference from the desired rotational speed cannot respond to the changed desired rotational speed. Therefore, when the desired rotational speed changes, overshooting or hunting occurs in the controlled actual rotational speed. Thus, according to the conventional technique, the controlled actual rotational speed cannot be smoothly and quickly converged to the changed desired rotational speed, spoiling the smooth driving feeling an operator might have.

SUMMARY OF THE INVENTION

It is, therefore, an object of the present invention to provide a method of and apparatus for controlling the air intake of an internal combustion engine, whereby the idling rotational speed of the engine is smoothly and quickly controlled to the desired rotational speed without overshoot and without hunting occurring causing the driving feeling to be remarkably improved, when the operating condition and/or the load condition is changed.

According to the present invention, the actual rotational speed is detected of the engine to produce a rotational speed signal which represents the detected rotational speed. The operating condition and/or the load condition of the engine is also detected to produce at least one engine condition signal which represents the detected operating condition and/or the detected load condition. In response to at least one engine condition signal, a desired rotational speed is determined which changes slowly in response to the change of the detected operating condition and/or the detected loaded condition. The difference between the actual rotational speed of the engine and the desired rotational speed, is calculated using the produced rotational speed signal and the determined desired rotational speed, to produce a control output signal which is determined depending upon the calculated difference. In response to the control output signal, the sectional area of an air bypass passage which bypasses a throttle valve of the engine to control the flow rate of air passing through the air bypass passage is adjusted so as to reduce the difference between the actual rotational speed and the desired rotational speed.

The above and other related objects and features of the present invention will be apparent from the description of the present invention set forth below, with reference to the accompanying drawings, as well as from the appended claims.

DETAILED DESCRIPTION OF THE PREFERRED EMBODIMENTS

Figure 1:
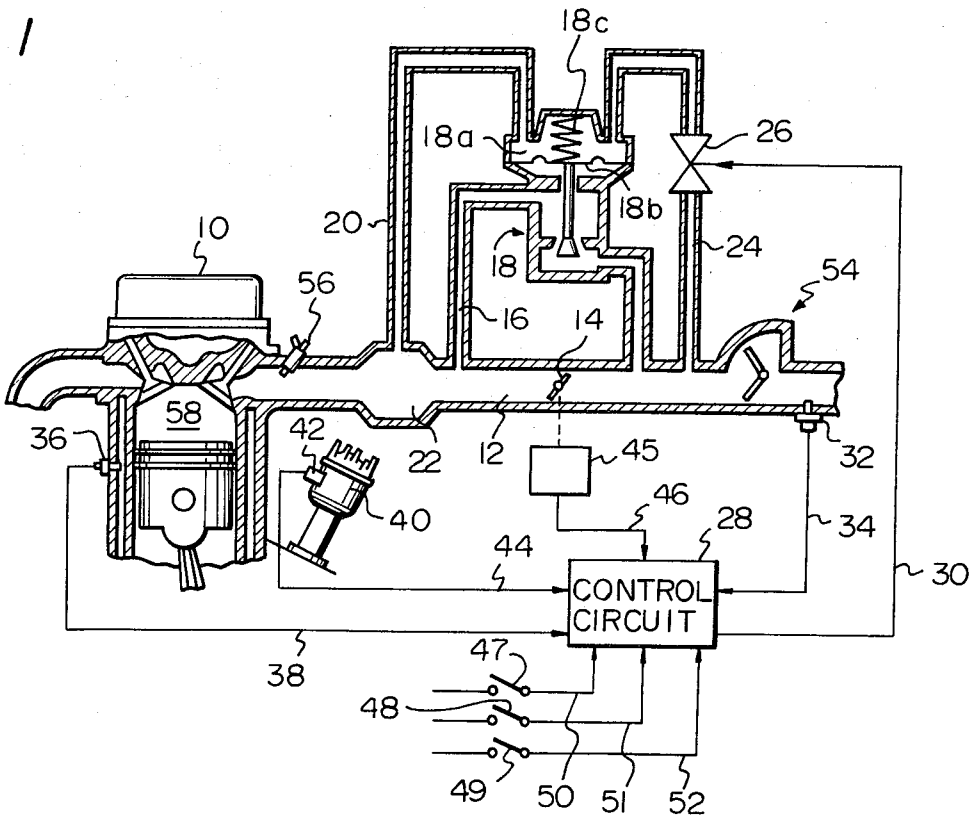
FIG. 1 is a schematic diagram illustrating a system in which the method of the present invention is used.

Referring to FIG. 1, in which an example of an electronic fuel injection control system of an internal combustion engine, according to the method of the present invention, is illustrated, a reference numeral 10 denotes an engine body, and 12 denotes an intake passage. A throttle valve 14 is disposed in the intake passage 12.

An air control valve (ACV) 18 is provided in an air bypass passage 16 which interconnects the intake passage 12 upstream of the throttle valve 14 with the intake passage 12 downstream of the throttle valve 14. The ACV 18 operates responsive to a vacuum pressure which is applied to a diaphragm chamber 18*a*, and controls the flow rate of air which passes through the air bypass passage 16. Namely, as the vacuum pressure increases in the diaphragm chamber 18*a*, a diaphragm 18*b* is pulled against a spring 18*c*, and the cross-sectional area of the flow passage is reduced to decrease the flow rate of the bypass air. Contrary to this, as the vacuum pressure decreases in the diaphragm chamber 18*a*, the diaphragm 18*b* is pushed by the spring 18*c*, whereby the cross-sectional area of the flow passage is increased to increase the bypass air flow rate.

The diaphragm chamber 18*a* of the ACV 18 communicates, via a conduit 20, with a surge tank 22 which is located on the downstream side of the throttle valve 14, and further communicates with the intake passage 12 on the upstream side of the throttle valve 14 via a conduit 24. A vacuum pressure switching valve (VSV) 26 is disposed in the conduit 24. The VSV 26 is operated by electrical signals that are sent from a control circuit 28 via a line 30 to control the vacuum pressure in the diaphragm chamber 18a of the ACV 18. Namely, as the VSV 26 is energized by an electrical current, the path opens so that air is permitted to flow into the diaphragm chamber 18a to decrease the vacuum pressure.

An air-temperature sensor 32 is disposed in the most upstream portion of the intake passage 12 to detect the temperature of the air that is sucked into the engine. The analog voltage which represents the detected intake air temperature is fed to the control circuit 28 via a line 34.

A coolant temperature sensor 36 is disposed in the cylinder block of the engine to detect the temperature of the coolant, and an analog voltage which represents the detected coolant temperature is sent to the control circuit 28 via a line 38.

A distributor 40 is provided with a crank angle sensor 42 which produces a pulse at every predetermined angle rotation, for example, every time the crank shaft turns by 30° CA. The produced pulses are sent to the control circuit 28 via a line 44.

A throttle position sensor 45 is attached to the rotary shaft of the throttle valve 14 to detect if the throttle valve 14 is at the idling position (fully closed position). The electrical signal which represents the detected result is fed to the control circuit 28 via a line 46.

The control circuit 28 further receives a signal, via a line 50 from a starter switch 47 which is turned on, when the engine is in the starting condition; a signal, via a line 51 from a neutral switch 48, which is turned on when the automatic transmission is shifted to the N range; and a signal, via a line 52 from an air conditioner actuating switch 49 which is turned on when the air conditioner is operated.

In electronic fuel injection control type internal combustion engines of this kind, as is well known, the flow rate of the air sucked into the engine is detected by an air flow sensor 54. Fuel, in an amount which corresponds to the detected flow rate of the intake air, is injected from a fuel injection valve 56 to produce the gas mixture which is fed to a combustion chamber 58. Therefore, if the flow rate of the bypass air through the air bypass passage 16 is controlled by the ACV 18 when the throttle valve 14 is at the idling position, the idling rotational speed of the engine is controlled depending upon by bypass air flow rate.

Figures 2, 2A:
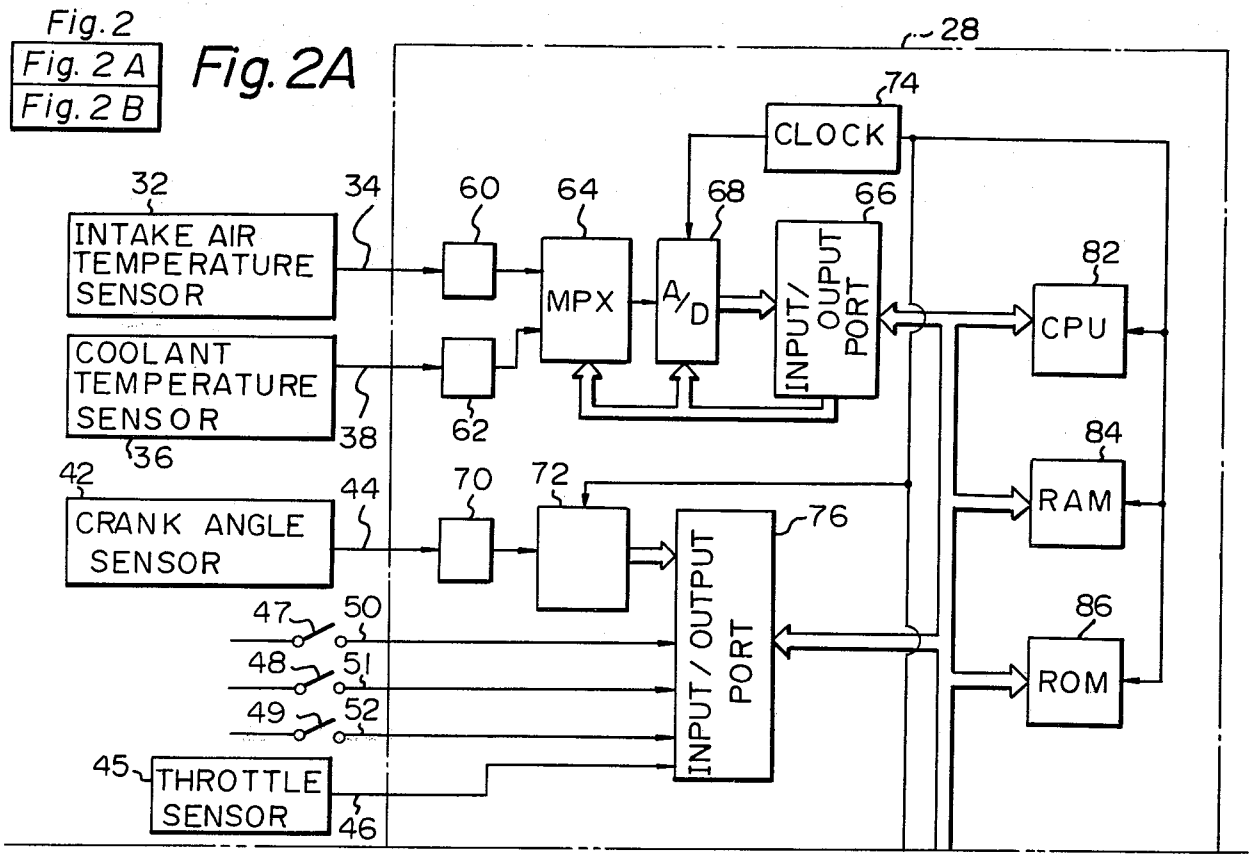
FIGS. 2A and 2B are a block diagram illustrating a control circuit in the system of FIG. 1.
Figure 2B:
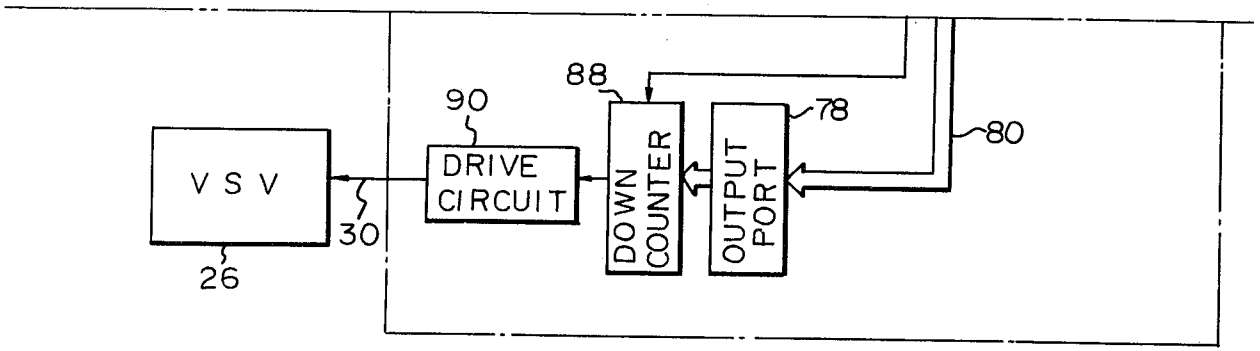

FIG. 2 is a block diagram which illustrates in detail the control circuit 28 of FIG. 1.

Voltage signals from the intake air temperature sensor 32 and the coolant temperature sensor 36 are fed to an analog multiplexer 64 via buffers 60 and 62, and are fed to an A/D converter 68 in sequence responsive to selection signals from an input/output port 66. In the A/D converter 68, the voltage signals are converted into signals in the form of a binary number. The converted binary signals are fed to the input/output port 66.

A pulse produced by the crank angle sensor 42 at every crank angle of 30° is fed to a speed signal-forming circuit 72 via a buffer 70. The speed signal-forming circuit 72 consists of a gate that is opened and closed by a pulse produced at every crank angle of 30°, and a counter which counts the number of clock pulses applied to the counter from a clock generator circuit 74 via the gate. The speed signal-forming circuit 72 forms speed signals in the form of a binary number which signals represent the actual rotational speed of the engine. The formed binary speed signals are applied to a predetermined bit position of an input/output port 76.

Signals from the throttle position sensor 45, the starter switch 47, the air conditioner actuating switch 49 and the neutral switch 48 are applied to predetermined bit positions of the input/output port 76.

The input/output ports 66, 76, and an output port 78, which will be mentioned later, are connected via a bus 80, to a central processing unit (CPU) 82, a random access memory (RAM) 84, and a read-only memory (ROM) 86, which are major components constituting a microcomputer. The RAM 84 temporarily stores a variety of input data, the data used in the arithmetic calculation, and the results of the arithmetic calculations. In the ROM 86 have been stored beforehand a program for processing the arithmetic calculations that will be mentioned later, and a variety of data necessary for processing the arithmetic calculations.

A binary control output $D_{out}$ for controlling the VSV 26 is fed from the CPU 82 to the output port 78, and then is set to a presettable down counter 88. The down counter 88 starts to count down the operation with respect to the set content at every predetermined period of time, for example, at every 50 msec. Namely, the down counter 88 reduces the set content one by one to zero, in response to the clock pulses from the clock generator circuit 74. Thus, the output of the high level is fed to a drive circuit 90 during the count down operation. The drive circuit 90 energizes the VSV 26 as far as it is served with the output of the high level. Therefore, the VSV 26 is energized at a duty ratio which corresponds to the control output $D_{out}$. Consequently, the bypass air flow rate is controlled depending upon the control output $D_{out}$.

Below is illustrated the content of an arithmetic calculation executed by the microcomputer. After the ignition switch is turned on and the initializing operation is carried out, the CPU 82 executes a processing routine, as partly illustrated in FIG. 3, at every predetermined period of time.

At a point 100, the CPU 82 introduces the operating condition signal and the load condition signal from the RAM 84. These signals consist of the detection data with respect to the coolant temperature THW and the intake air temperature THA, the throttle position signal from the throttle position sensor 45, and the signals from the starter switch 47, the neutral switch 48 and the air conditioner actuating switch 49, which have been previously input and stored in the RAM 84. Then, at a point 101, the desired rotational speed $N_F$ is calculated depending upon the introduced operating condition signal and the introduced load condition signal by using, for example, the following equation:

$$N_F = A \cdot f(THW) + B$$

where A and B are variable values determined in accordance with the intake air temperature THA, with the throttle position, with whether the shift position of the automatic transmission is the N range or the D range, with whether the air conditioner is being operated or not, and with whether the engine is in the starting condition or not. Furthermore, f(THW) is a temperature coefficient depending upon the coolant temperature THW. The coefficient f(THW) increases if the coolant temperature THW decreases, and vice versa. The coefficient f(THW), however, is maintained at 1.0 when the coolant temperature THW is higher than or equal to 80° C.

At a next point 102, the previous transitional value $N_{Fi-1}$ with respect to the desired rotational speed, which value $N_{Fi-1}$ was obtained and stored in the RAM 84 in the previous calculation cycle of this processing routine, is introduced from the RAM 84. Then, at a point 103, the magnitude between the desired rotational speed $N_F$ calculated at the point 101 and the previous transitional value $N_{Fi-1}$ introduced at the point 102 are compared each other. If $N_F \geqq N_{Fi-1}$, the program proceeds to a point 104 where a present transitional value $N_{Fi}$ is calculated by adding a predetermined increment value $\alpha$ to the previous transitional value $N_{Fi-1}$. At points 105 and 106, the calculated present transitional value $N_{Fi}$ is limited to a value not higher than the calculated desired rotational speed $N_F$.

If $N_F < N_{Fi-1}$, the program proceeds from the point 103 to a point 107. At the point 107, a present transitional value $N_{Fi}$ is calculated by subtracting a predetermined decrement value $\beta$ from the previous transitional value $N_{Fi-1}$. At the point 108 and the point 106, the calculated present transitional value $N_{Fi}$ is limited to a value not lower than the calculated desired rotational speed $N_F$.

At a next point 109, the CPU 82 stores the calculated and limited present transitional value $N_{Fi}$ in a predetermined region in the RAM 84. The stored value is utilized as the previous transitional value $N_{Fi-1}$ in the next calculation cycle of the processing routine. Then, at a point 110, the CPU 82 introduces from the RAM 84 a detection datum related to the actual rotational speed $N_E$ of the engine, and at a point 111, calculates the control output $D_{out}$ based upon the difference between the introduced actual rotational speed $N_E$ and the calculated and limited present transitional value $N_{Fi}$. The calculation in the point 111 can be performed according to one of the following two methods. One method is to find the control output $D_{out}$ according to a relation, $$D_{out} = D_{out}' + C \cdot (N_{Fi} - N_E)$$

where $D_{out}'$ denotes a control output in the previous calculation cycle and C denotes a constant. Another method is to find the control output $D_{out}$ employing a predetermined reference value $D_O$ according to a relation, $$D_{out} = D_O + D \cdot (N_{Fi} - N_E)$$

where D denotes a constant.

In the point 111 as mentioned above, the control output $D_{out}$ is increased or decreased responsive to the difference $N_F - N_{Fi}$. If it is required, at the point 111, the CPU 82 corrects the calculated control output $D_{out}$ to be additionally increased or decreased, depending upon the operating condition of the engine and upon the load condition of the engine. Then, at a point 112, the calculated control output $D_{out}$ is fed to the output port 78 shown in FIG. 2.

Figure 3A:
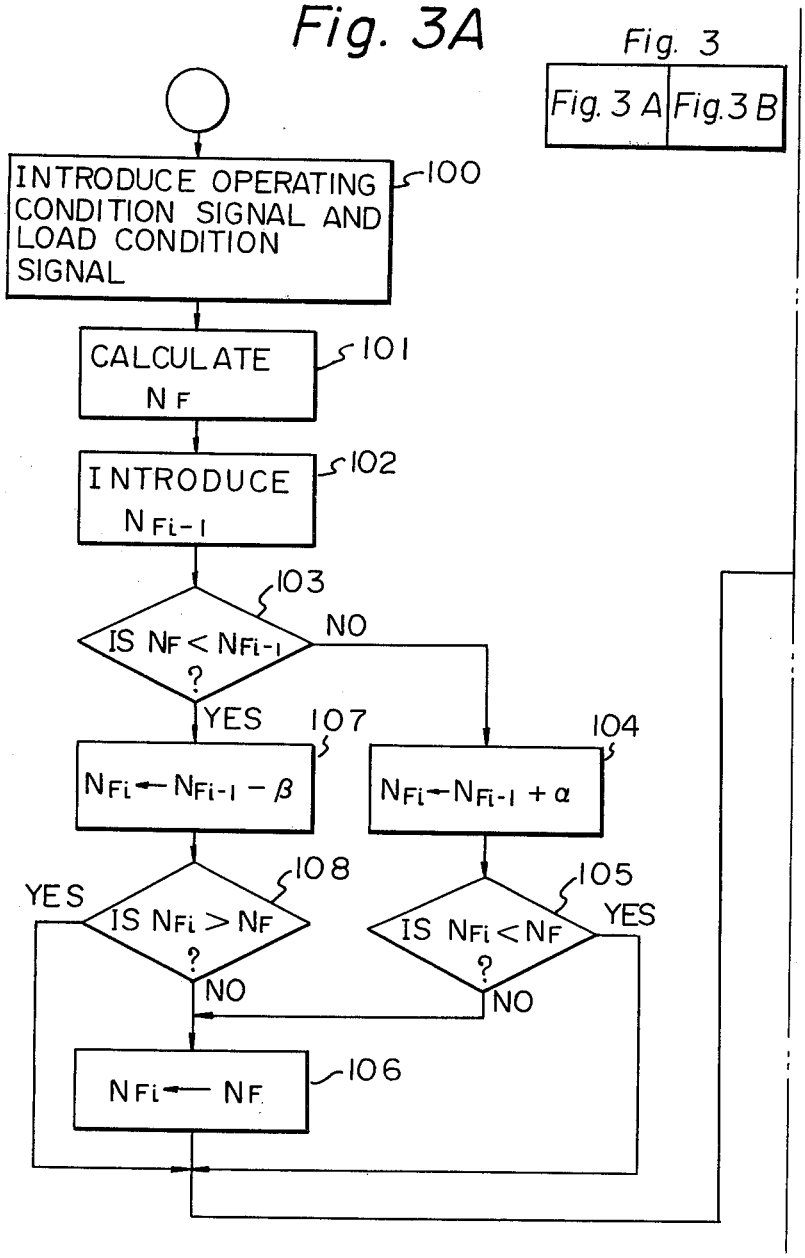
FIGS. 3A and 3B are a flow diagram illustrating the operation of the digital computer in the control circuit of FIG. 2.
Figure 3B:
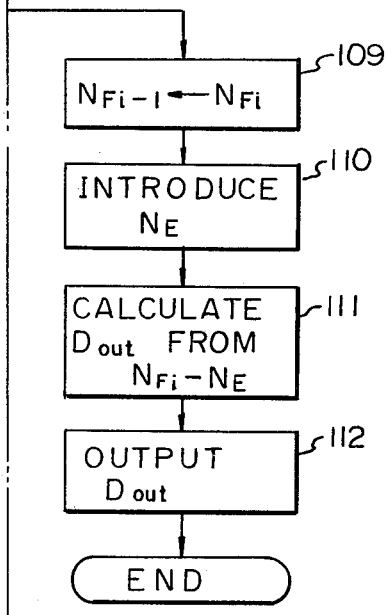

According to the above-mentioned processing routine of FIG. 3, the desired rotational speed $N_F$ is slowly changed at a predetermined increment or decrement rate when it is required to change the desired rotational speed $N_F$. Therefore, the actual rotational speed $N_E$ which is controlled by the closed loop, depending upon the difference from the desired rotational speed $N_F$, is smoothly and quickly converged to the changed desired speed without overshoot and without the occurrence of hunting, when the desired rotational speed $N_F$ is changed.

Figure 4:
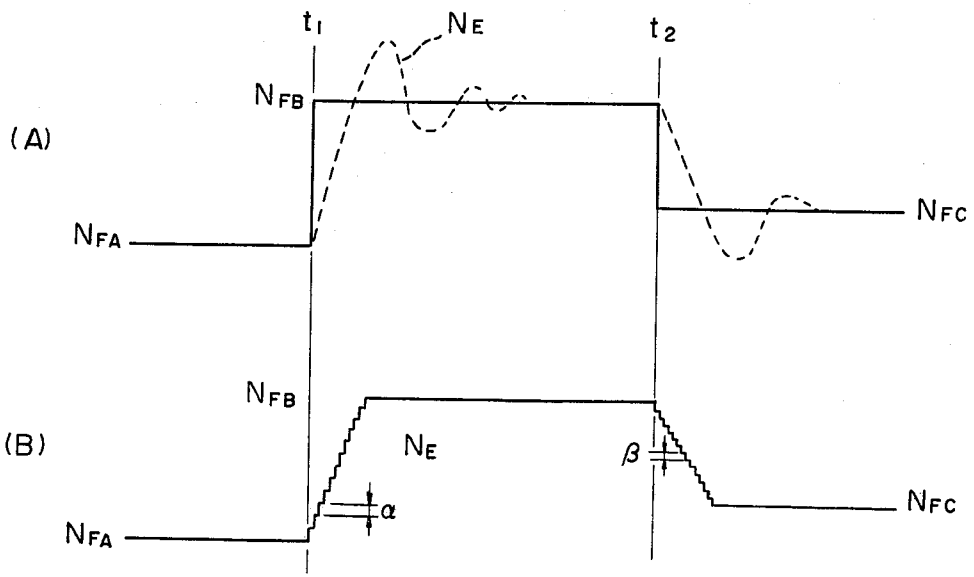
FIG. 4 contains two wave forms (A) and (B) for illustrating the effects of the operation according to the program shown in FIGS. 3A and 3B.

FIG. 4 is to explain the effects of the present invention, wherein the diagram (A) illustrates the characteristics of $N_F$ and $N_E$ when the air intake is controlled by the conventional technique, and the diagram (B) illustrates the characteristics of $N_F$ and $N_E$ when the air intake is controlled by the processing routine of FIG. 3. In FIG. 4, it is assumed that the operating condition and/or the load condition is changed at times $t_1$ and $t_2$, and thus the desired rotational speed is required to change from $N_{FA}$ to $N_{FB}$, and from $N_{FB}$ to $N_{FC}$, respectively. According to the conventional technique, as shown by a solid line in FIG. 4 (A), the desired rotational speed is instantly changed from $N_{FA}$ to $N_{FB}$, from $N_{FB}$ to $N_{FC}$ at the times $t_1$, $t_2$, respectively. Therefore, as shown by a broken line in FIG. 4 (A), the controlled actual rotational speed $N_E$ overshoots and oscillates (hunts) after the times $t_1$ and $t_2$. However, according to the processing routine of FIG. 3, as shown by a solid line in FIG. 4 (B), the desired rotational speed is slowly changed from $N_{FA}$ to $N_{FB}$, from $N_{FB}$ to $N_{FC}$ even if the operating condition and/or the load condition is changed at the times $t_1$, $t_2$, respectively. As a result, as shown by a solid line in FIG. 4 (B), the desired rotational speed is smoothly and quickly converged to the value $N_{FB}$ or $N_{FC}$ without overshoot and oscillation.

The aforementioned increment value $\alpha$ may be equal to the decrement value $\beta$, or, in some cases, the increment value $\alpha$ may not be equal to the decrement value $\beta$ as shown in FIG. 4(B). Furthermore, these values $\alpha$ and $\beta$ may be changed in accordance with the operating condition and/or with the load condition. In other words, the increment rate and the decrement rate of the desired rotational speed may be equal to or may not be equal to each other. Furthermore, these rates may be changed depending upon the operating condition and/or upon the load condition.

According to the present invention, as mentioned in detail in the foregoing, the controlled actual rotational speed can be smoothly and quickly converged to a changed desired rotational speed without overshoot and oscillation, when the desired rotational speed is changed depending upon the change of the operating condition of the engine and/or of the load condition of the engine. As a result, the driving feeling, when the operating condition and/or the load condition is changed, can be remarkably improved. Furthermore, since the controlled actual rotational speed can respond smoothly and quickly to the changed desired rotational speed, even if the desired rotational speed is greatly changed, the desired rotational speed can be freely selected from a small value to a large one in response to various operating conditions and to various load conditions of the engine.

As many widely different embodiments of the present invention may be constructed without departing from the spirit and scope of the present invention, it should be understood that the present invention is not limited to the specific embodiments described in this specification, except as defined in the appended claims.

We claim:

1. A method of controlling the air intake of an internal combustion engine having an intake passage, a throttle valve disposed in the intake passage, and an air bypass passage which interconnects the intake passage at a position located upstream of the throttle valve with the intake passage at a position located downstream of the throttle valve, said method comprising the steps of:

detecting the actual rotational speed of the engine to produce a rotational speed signal which represents the detected rotational speed;

producing at least one engine condition signal related to at least one of the operating condition and the load condition of the engine;

repeatedly determining, in response to said at least one engine condition signal, a desired rotational speed;

gradually changing a transitional rotational speed from the previous desired rotational speed toward the current desired rotational speed in response to a change in said at least one engine condition signal;

by using the produced rotational speed signal and the transitional rotational speed, calculating the difference between the actual rotational speed of the engine and the transitional rotational speed, to produce a control output signal which is determined depending upon the calculated difference; and adjusting, in response to the control output signal, the sectional area of the air bypass passage to control the flow rate of air passing through the air bypass passage so as to reduce the difference between the actual rotational speed and the transitional rotational speed.

2. A method as claimed in claim 1, wherein said changing step changes said transitional rotational speed at a predetermined increment rate with respect to time when said desired rotational speed increases, and at a predetermined decrement rate with respect to time when said desired rotational speed decreases.

3. A method as claimed in claim 1, wherein said engine condition signal producing step includes a step of producing an engine condition signal related to a coolant temperature of the engine.

4. A method as claimed in claim 1, wherein said engine condition signal producing step includes a step of producing an engine condition signal related to an intake air temperature of the engine.

5. A method as claimed in claim 1, wherein said engine condition signal producing step includes a step of producing an engine condition signal related to whether the throttle valve is at a fully closed position or not.

6. A method as claimed in claim 1, wherein said engine condition signal producing step includes a step of producing an engine condition signal related to whether the engine is starting or not.

7. A method as claimed in claim 1, wherein said engine condition signal producing step includes a step of producing an engine condition signal related to whether the shift position of an automatic transmission is in the neutral range or not.

8. A method as claimed in claim 1, wherein said engine condition signal producing step includes a step of producing an engine condition signal related to whether an air conditioner is operated or not.

9. Apparatus for controlling the air intake of an internal combustion engine having an intake passage and a throttle valve disposed in the intake passage comprising:

an air bypass passage which interconnects the intake passage at a position located upstream of the throttle valve with the intake passage at a position located downstream of the throttle valve;

means for producing a rotational speed signal related to the actual rotational speed of the engine;

means for producing at least one engine condition signal related to at least one of the operating condition and the load condition of the engine;

controlling means for (1) repeatedly determining, in response to said at least one engine condition signal, a desired rotational speed, (2) gradually changing a transitional rotational speed from the previous desired rotational speed toward the current desired rotational speed in response to a change in said at least one engine condition signal, and (3) by using the produced rotational speed signal and the transitional rotational speed, calculating the difference between the actual rotational speed of the engine and the transitional rotational speed, to produce a control output signal which is determined depending upon the calculated difference; and means for adjusting, in response to the control output signal, the sectional area of the air bypass passage to control the flow rate of air passing through the air bypass passage so as to reduce the difference between the actual rotational speed and the transitional rotational speed.

10. Apparatus as in claim 9, wherein said controlling means changing function includes the function of changing said transitional rotational speed at a predetermined increment rate with respect to time when it is to be increased, and being changed at a predetermined decrement rate with respect to time when it is to be decreased.

11. Apparatus as in claim 9, wherein said condition signal producing means includes means for producing an engine condition signal related to a coolant temperature of said engine.

12. Apparatus as in claim 9, wherein said condition signal producing means includes means for producing an engine condition signal related to an intake air temperature.

13. A method as claimed in claim 9, wherein said condition signal producing means includes means for producing an engine condition signal related to whether the throttle valve is at a fully closed position or not.

14. Apparatus as in claim 9, wherein said condition signal producing means includes means for producing an engine condition signal related to whether the engine is starting or not.

15. Apparatus as in claim 9, wherein:

said engine is in a vehicle having an automatic transmission, said transmission having a shift position in a neutral range; and said condition signal producing means includes means for producing an engine condition signal which indicates whether the shift position of said automatic transmission is in the neutral range or not.

16. Apparatus as in claim 9, wherein:

said engine is in a vehicle having an air conditioner; and said condition signal producing means includes means for producing an engine condition signal which indicates whether said air conditioner is operated or not.

* * * * *